US008506239B2

(12) United States Patent
Benkler et al.

(10) Patent No.: US 8,506,239 B2
(45) Date of Patent: Aug. 13, 2013

(54) TURBINE WITH AT LEAST ONE ROTOR WHICH COMPRISES ROTOR DISKS AND A TIE-BOLT

(75) Inventors: Francois Benkler, Ratingen (DE); Ulrich Ehehalt, Essen (DE); Harald Hoell, Wächtersbach (DE); Walter Loch, Mülheim an der Ruhr (DE); Peter-Andreas Schneider, Münster (DE)

(73) Assignee: Siemens Aktiengesellschaft, Munich (DE)

( * ) Notice: Subject to any disclaimer, the term of this patent is extended or adjusted under 35 U.S.C. 154(b) by 855 days.

(21) Appl. No.: 12/530,473

(22) PCT Filed: Feb. 15, 2008

(86) PCT No.: PCT/EP2008/051880

§ 371 (c)(1),
(2), (4) Date: Feb. 11, 2010

(87) PCT Pub. No.: WO2008/110430

PCT Pub. Date: Sep. 18, 2008

(65) Prior Publication Data

US 2010/0143149 A1 Jun. 10, 2010

(30) Foreign Application Priority Data

Mar. 12, 2007 (EP) ..... 07005082

(51) Int. Cl.
*F01D 5/03* (2006.01)

(52) U.S. Cl.
USPC ..... 415/110; 415/116

(58) Field of Classification Search
USPC ..... 415/111, 112, 115, 116, 117, 229, 415/230, 231, 216.1; 416/96 R, 174, 244 A, 416/500
See application file for complete search history.

(56) References Cited

U.S. PATENT DOCUMENTS

| | | | | |
|---|---|---|---|---|
| 3,304,052 | A | 2/1967 | Warner et al. | |
| 3,680,979 | A * | 8/1972 | Hansen et al. | 416/198 R |
| 3,749,516 | A | 7/1973 | Samurin et al. | |
| 5,951,250 | A * | 9/1999 | Suenaga et al. | 416/96 R |
| 2004/0007830 | A1 | 1/2004 | Uematsu et al. | |

FOREIGN PATENT DOCUMENTS

| | | | |
|---|---|---|---|
| CH | 265291 | A | 11/1949 |
| EP | 0125935 | A1 | 11/1984 |
| EP | 0902163 | A2 | 3/1999 |

(Continued)

OTHER PUBLICATIONS

English translation of JP 10266802 A, Shibuka Naoki, Oct. 6, 1998.*

*Primary Examiner* — Edward Look
*Assistant Examiner* — Maxime Adjagbe

(57) ABSTRACT

A gas turbine is provided. The gas turbine includes at least one rotor, having rotor blades arranged on the periphery of rotor disks in a plurality of radial planes, and a tie-bolt extending along slots in the rotor disks and holding the rotor disks together as a unit. At least one annular spacer for fixing the position of the tie-bolt in relation to the center line of the rotor disks is also provided. The spacer includes through-openings that are arranged radially in relation to the tie-bolt or to its center line and that extend coaxially.

19 Claims, 3 Drawing Sheets

(56) References Cited

FOREIGN PATENT DOCUMENTS

| | | | |
|---|---|---|---|
| FR | 2111096 | A | 2/1972 |
| GB | 800524 | A | 8/1958 |
| JP | 05001567 | A | 1/1993 |
| JP | 09105306 | A | 4/1997 |
| JP | 10266802 | A | 10/1998 |
| JP | 2004514841 | A | 5/2004 |
| RU | 2230195 | C2 | 11/2003 |

* cited by examiner

TURBINE WITH AT LEAST ONE ROTOR WHICH COMPRISES ROTOR DISKS AND A TIE-BOLT

CROSS REFERENCE TO RELATED APPLICATIONS

This application is the US National Stage of International Application No. PCT/EP2008/051880, filed Feb. 15, 2008 and claims the benefit thereof. The International Application claims the benefits of European Patent Office application No. 07005082.8 EP filed Mar. 12, 2007, both of the applications are incorporated by reference herein in their entirety.

FIELD OF INVENTION

The invention refers to a gas turbine according to the claims.

BACKGROUND OF INVENTION

Multistage gas turbines with at least one rotating component, or rotor, which has rotor blades which are arranged in a plurality of radial planes on the periphery of rotor disks, are basically known in diverse design forms.

Furthermore, it is known, at least in the case of gas turbines, to design the individual rotor disks with abutting end faces and in a form-fitting manner so that by means of a tie-bolt which extends through the rotor disks they can be held together as a unit. With increasing overall length, however, the freely vibrating length, i.e. the unsupported length of the tie-bolt, increases. As a result of this, the natural frequencies shift to a level which is close to the rotational frequency of the rotor so that during operation or when accelerating impermissibly high vibration amplitudes can occur. These can not only destroy the tie-bolt but also the entire gas turbine. This also applies especially to gas turbines in which the tie-bolt extends through the compressor, then through a center hollow shaft with the combustion chambers located there radially on the outside, and finally through the turbine.

For this purpose, U.S. Pat. No. 3,749,516 discloses a similarly built rotating component of a twin radial compressor. The rotating component which is known from this comprises a plurality of rotor disks and a centrally arranged hollow shaft. A tie-bolt extends centrally through the hollow shaft and through the rotor disks and by means of end pieces which are screwed on at the end tightly clamps the rotor disks and the hollow shaft to each other. In order to fix the tie-bolt in its position inside the rotor, provision is made on this tie-bolt for a sleeve with legs which are elastically fastened on the end and supported on the hollow shaft via a screw.

SUMMARY OF INVENTION

The invention is based on the object of providing measures in order to prevent especially natural vibrations of the tie-bolt regardless of the speed which is constant during operation of the stationary gas turbine. All rotating parts of the gas turbine in this case are to form a unit which is as rigid as possible.

For achieving this object, the invention with the features of the characterizing part of the claims provides that the passage is formed in an annular configuration and formed for the guiding through of a cooling medium, and is delimited by a separation pipe radially on the outside, wherein the recesses serve as through-openings for the cooling medium.

The spacer according to the invention is basically a spring-ring with coaxially extending through-openings. The spring-ring increases the damping or rigidity of the tie-bolt in the rotating component/rotor and is sufficiently stable to hold the tie-bolt in its intended position regardless of the speed. The spring-ring can be simply installed, wherein a sufficient pre-tensioning is provided despite its spring characteristics. The functionality is ensured, therefore, even at high speeds.

The use of spacers additionally increases not only the natural frequency of the tie-bolt itself, but also the natural rigidity of all the components.

Also associated with this is that spacers according to the invention are basically also used in the region of cooling and separation pipes which encompass the tie-bolt with clearance in a specific axial section. The spacers in this case are located between the tie-bolt and the separation pipe which guides the cooling medium and delimits the annular passage on the outside. If necessary, a further annular passage can be formed in this connection between an inner or first separation pipe and an outer or second separation pipe so that then first spacers are provided between tie-bolt and inner separation pipe on the one hand and if necessary second spacers are provided between the inner separation pipe and an outer separation pipe, by means of which the tie-bolt can be supported in places against the radially further out rotor components which are associated with the rotor. As a result of the possibly even multiple supporting along its extent, the free vibratable length of the tie-bolt can be significantly shortened. With this measure, the margin between the natural frequency of the tie-bolt and the rotational frequency of the rotor can be increased, as a result of which its vibration tendency is significantly reduced. A safer operation of the gas turbine can therefore be ensured.

It is therefore possible with simple means to successfully achieve the aforementioned object.

Further features of the invention result from dependent claims and from the drawing in conjunction with the description.

BRIEF DESCRIPTION OF THE DRAWINGS

The invention is subsequently described in more detail based on exemplary embodiments which are shown in the drawing. In this case, in the drawing.

DETAILED DESCRIPTION OF INVENTION

Figure 1:
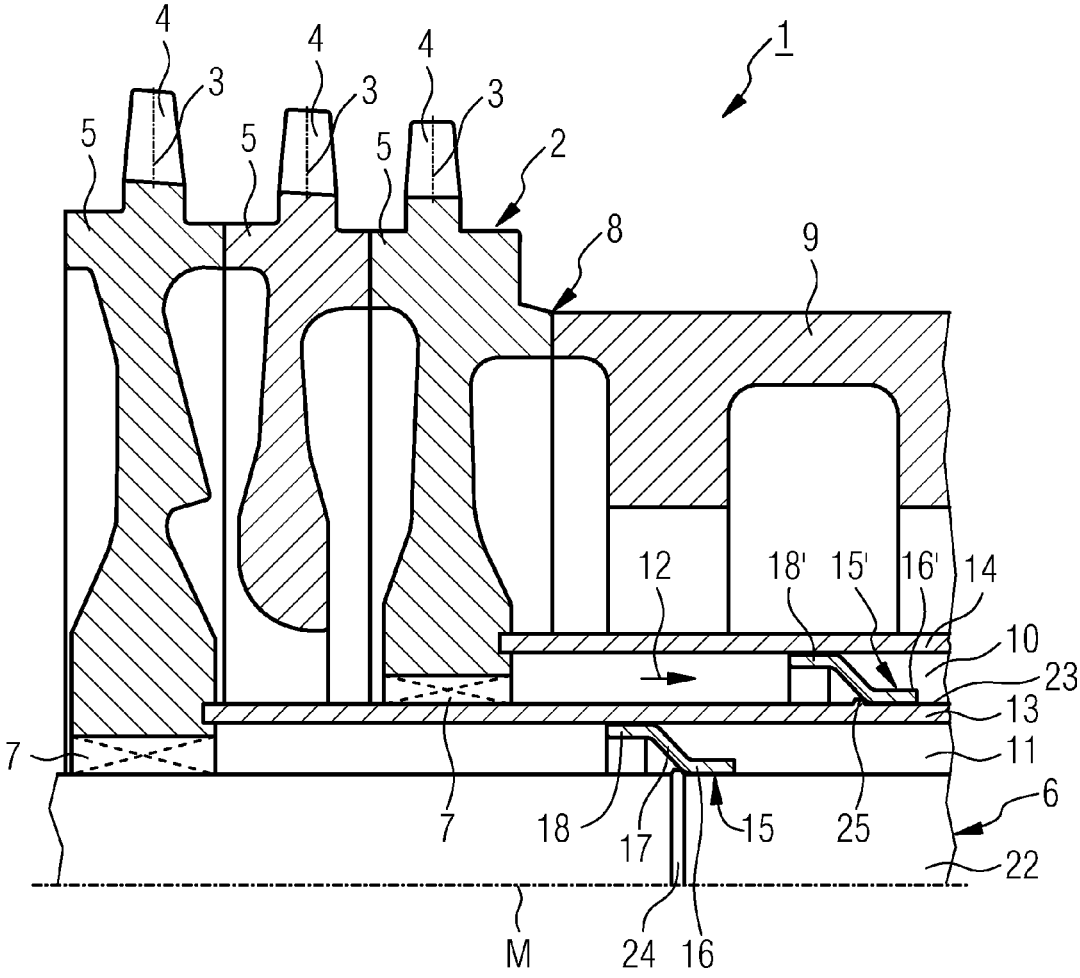
FIG. 1 shows in section, and also partially in section, a part of the rotating component/rotor of a multistage gas turbine.
Figure 2:
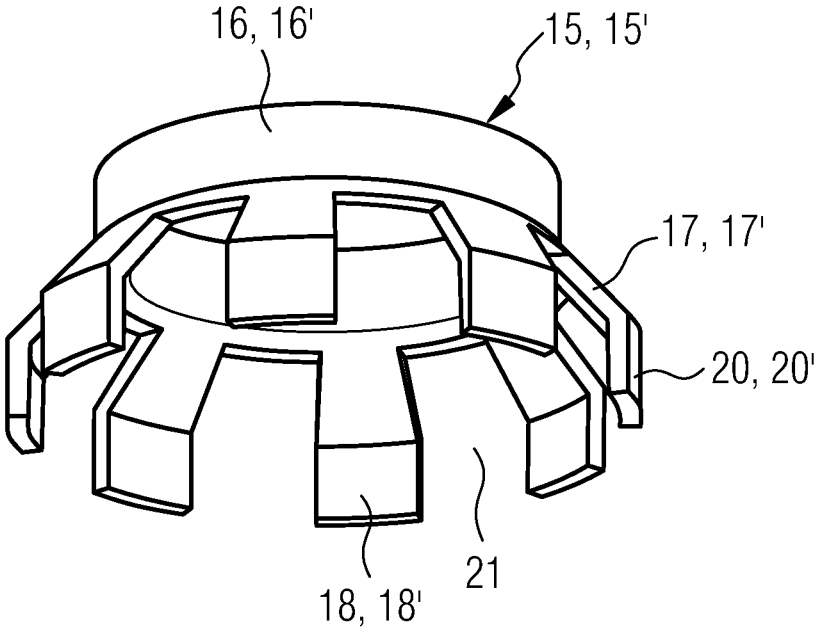
FIG. 2 shows obliquely from below a perspective view of a spacer on another scale.
Figure 3:
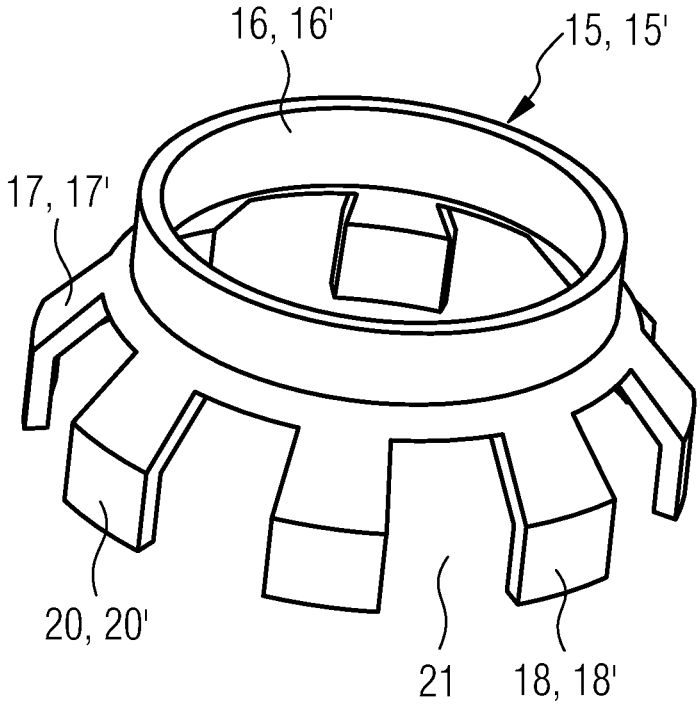
FIG. 3 shows a perspective view as in FIG. 2, but slightly obliquely from above.

A rotor 2 of a multistage gas turbine 1, according to the broken-away sectional view in FIG. 1, comprises rotor disks 5 which are arranged in a plurality of planes and carry rotor blades 4 on the periphery. A tie-bolt 6 extends along centrally arranged recesses 7 in the rotor disks 5 through the compressor section of the gas turbine 1, which is on the left in FIG. 1, and is anchored, in a way which is not shown, in one of the rotor disks, which are not shown, or in a suitable rotor end section.

The pretensioned tie-bolt 6 presses the rotor disks 5 and also further rotor components of the turbine unit together in a form-fitting manner in a basically known way.

A center hollow shaft 9 is located axially next to the rotor disks 5 which are associated with the compressor of the gas turbine and with its opposite end, which is not shown, abuts against one of the rotor components of the turbine unit. Radially on the outside of this center hollow shaft 9, the combustion chambers are located inside the housing of the gas turbine.

At least one annular passage 10 or 11 is located between the center hollow shaft 9 and the tie-bolt 6. The passages 10, 11 serve in each case for the guiding of a cooling medium 12 from the compressor-side section of the rotor 2 to the turbine-side section. The cooling medium 12 is symbolized in FIG. 1 by means of an arrow.

The passage 11 which is annular in cross section and guides the cooling medium 12 can be enclosed by a first or inner separation pipe 13, through which passage the tie-bolt 6 centrally extends. Moreover, the further annular cooling passage 10 for guiding a cooling medium 12 can be arranged between the first or inner separation pipe 13 and a second and outer separation pipe 14.

For accurate positional fixing of the tie-bolt 6 in the inner separation pipe 13 at least one spacer 15 is provided. This spacer 15 is a spring-elastic ring element and comprises at least one support ring 16 which has radially extending support arms 17, and on each support arm 17 has in each case a support foot 18 at its end, as results from FIGS. 2 to 6 in conjunction with FIG. 1.

According to the exemplary embodiments which are shown in the figures the spacer 15 or the spring-elastic ring element is in one piece, wherein the support arms 17 extending radially to the support ring 16 and end at the support feet 18. According to the exemplary embodiments, each support foot 18 has a support face 20 on its end, with which the spacer 15 or its support arm 17 abuts in each case against the inner side of the separation pipe 13.

The support arms 17 extend from the support ring 16 to the support feet in each case at an angle to the center axis M of the rotor 2. As a result of this, an imaginary hinge point is formed on the ring-side end of the support arm 17, around which the support arm 17 can pivot in the radial direction if it is correspondingly bent by centrifugal forces. Centrifugal forces bring about the effect of the support feet 18 not becoming detached from their contact surface as a result of centrifugal force, but abutting, with spreading force, all the more on their contact surface corresponding to a higher speed of the rotor 2, wherein at the same time the radial extent between support ring 16 and support foot 18 can safely become no smaller. This applies at least to the case when the support ring in the installed state is located radially on the inside and the support feet 18 are located radially on the outside.

Constructionally similar spacers 15', which if necessary have only slightly different dimensions, are basically also provided for fixing the annular passage 10 for the cooling medium, as results from FIG. 1. The support ring 16' in this case abuts on the outside against the first or inner separation pipe 13 and is supported with its support feet 18' on the inside on the second or outer separation pipe 14.

The separation pipe 14 in this case additionally serves as the radially inner boundary for the center hollow shaft 9, as results from FIG. 1.

On account of the support arms 17, the spacer 15 has recesses 21 which in the installed state extend radially to the tie-bolt 6 or to its center line M and also coaxially to the tie-bolt 6. The spacers 15 consequently fix not only the tie-bolt 6 and/or the two separation pipes 13 and 14 relative to the center line M of rotor 2 and tie-bolt 6, but they also enable a free and unhindered coaxial flow of the cooling medium 12. In the installed state, the recesses 21 form in each case through-openings.

The spacer 15, 15' is basically not only in one piece, but on account of its design and on account of the material which is used is also spring-elastic.

Figure 4:
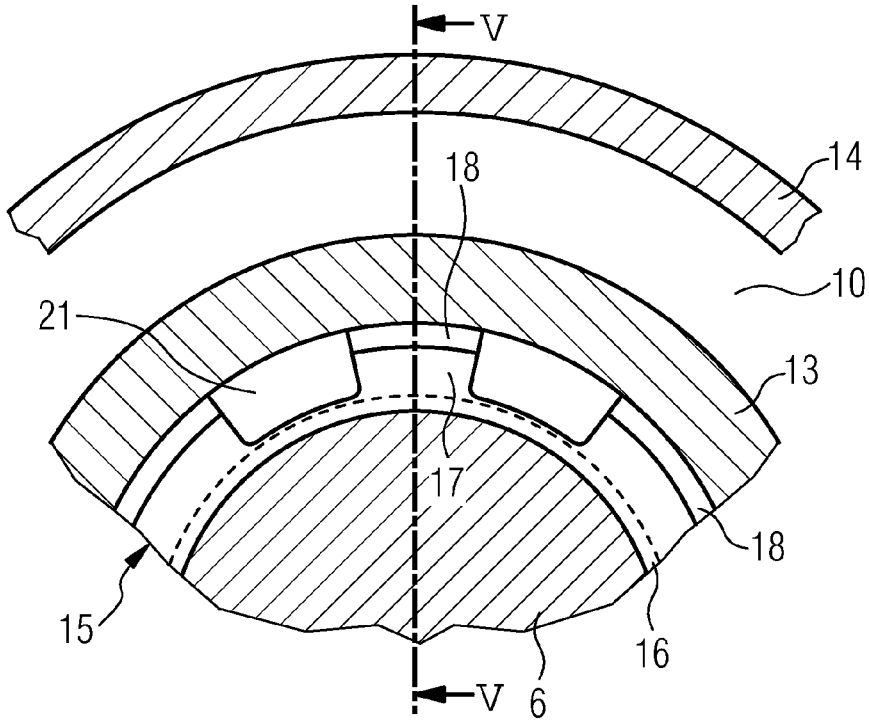
FIG. 4 shows in section in each case an end view of a spacer on a tie-bolt and also an inner and an outer separation pipe for forming an annular passage for a cooling medium.
Figure 5:
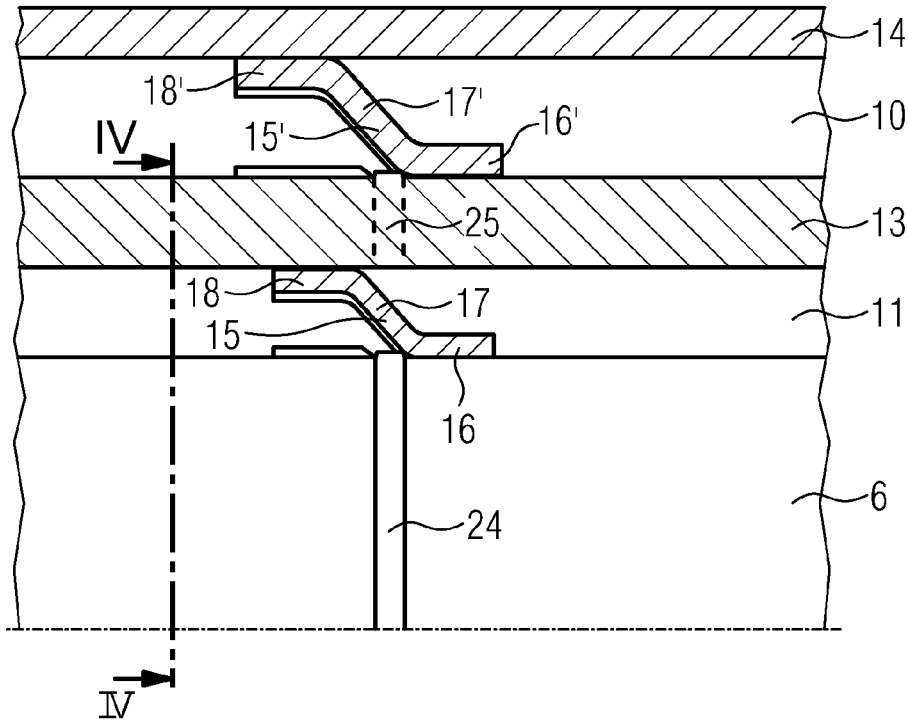
FIG. 5 shows a section along the line V-V in FIG. 4.

According to the exemplary embodiment which is shown in FIG. 4, because of the spacers 15 and their support arms 17 and their support feet 18 about half the annular cross section remains for forming free through-openings 21. Therefore about half the passage cross section is made available to the cooling medium for throughflowing.

Regardless of this, the spacers 15, 15' are immovably fixed in the radial direction on the periphery 22 of the tie-bolt 6 or on the periphery 23 of the one separation pipe 13. For this purpose, the spacers 15, 15' with their support ring 16, 16' are expediently thermally shrunk onto the tie bolt 6 and separation pipe 13 which carry them.

Finally, the tie-bolt 6 and if necessary also the inner separation pipe 13 which carry spacers 15, 15' in each case, have stops 24, 25 for the spacers 15, 15'. These stops 24, 25 according to the exemplary embodiments which are shown in the figures are in each case an encompassing bead and in the axial direction define exactly that position against which the spacer 15, 15' is to abut during the thermal shrinking-on.

Spacers of a similar type, like the spacers 15 or 15', can basically also be arranged between the rotor disks 5 which carry rotor blades 4 on their periphery and the tie-bolt 6. In FIG. 1, this is symbolically indicated in the region of the recesses 7 by means of crossing broken lines. In particular, the first rotor disk next to the center hollow shaft can expediently be concretely connected to one or more spacers 15 of the type which is of interest here. The same can basically also apply, however, to other rotor disks 5, for which reason these are either connected directly to the tie-bolt 6 or to the first or inner separation pipe 13.

The invention claimed is:

1. A gas turbine, comprising:

a rotor which includes a plurality of rotor blades arranged in a plurality of planes on a periphery of a plurality of rotor disks; and a tie-bolt, wherein the tie-bolt extends along a first recess in the plurality of rotor disks and holds the plurality of rotor disks together as a unit, wherein an inner annular passage and/or an outer annular passage in the rotor encompasses the tie-bolt, wherein within the inner annular passage and/or the outer annular passage an annularly designed spacer is provided for fixing a position of the tie-bolt relative to a center line of the rotor, wherein the spacer includes a plurality of second recesses, the plurality of second recesses are arranged radially to the tie-bolt or to the center line and extend coaxially, wherein the inner annular passage and/or the outer annular passage is used for guiding a cooling medium through and is delimited by an inner separation pipe and/or an outer separation pipe radially on the outside, and wherein the plurality of second recesses serve as through-openings for the cooling medium, wherein the spacer is a spring-elastic ring element.

2. The gas turbine as claimed in claim 1, wherein the spacer is one piece.

3. The gas turbine as claimed in claim 1, wherein each of the two passages are arranged in the rotor and are delimited radially on the outside by either the inner or outer separation pipe in each case or by a center hollow shaft.

4. The gas turbine as claimed in claim 1, wherein the spacer is immovably fixed at least in the radial direction on the periphery of the tie-bolt and/or on the periphery of the inner or outer separation pipe, and wherein the inner or outer separation pipe delimits either the inner annular passage or the outer annular passage.

5. The gas turbine as claimed in claim 1, wherein a stop is provided on the tie-bolt and/or on the inner separation pipe in order to fix the spacer in an axial position.

6. The gas turbine as claimed in claim 5, wherein a bead is provided as the stop on the tie-bolt and/or on the inner separation pipe.

7. The gas turbine as claimed in claim 1, wherein the tie-bolt delimits the inner annular passage radially on the inside, and wherein the inner separation pipe delimits the inner annular passage on the outside.

8. The gas turbine as claimed in claim 1, wherein the outer annular passage encompasses the inner separation pipe and is delimited by the outer separation pipe on the outside.

9. The gas turbine as claimed in claim 1, wherein a plurality of spacers includes two types of spacers constructionally similar but having different dimensions, a first spacer having a first dimension and a second spacer having a second dimension.

10. The gas turbine as claimed in claim 9, wherein the first spacer or the second spacer is arranged between the inner separation pipe and the outer separation pipe in the outer annular passage.

11. The gas turbine as claimed in claim 10, wherein the second spacer is arranged and positionally fixed in the outer annular passage on the inner separation pipe side.

12. The gas turbine as claimed in claim 10, wherein the first spacer comprises a support ring including a plurality of radially extending support arms, and wherein each support arm includes a support face on an end of the support arm.

13. The gas turbine as claimed in claim 12, wherein the plurality of second recesses are arranged between adjacent support arms of the support ring in such a way that essentially half of an annular cross section of the inner annular passage or the outer annular passage is made available for through flowing of the cooling medium.

14. The gas turbine as claimed in claim 12, wherein each support face is arranged on a free end of the corresponding support arm on a support foot.

15. The gas turbine as claimed in claim 14, wherein each support arm extends from the support ring to the corresponding support foot at an angle to the center line of the rotor.

16. The gas turbine as claimed in claim 12, wherein each support face of the first spacer abuts a first inner side of the inner separation pipe.

17. The gas turbine as claimed in claim 9, wherein a support face of the second spacer abuts a second inner side of the outer separation pipe.

18. The gas turbine as claimed in claim 1, wherein the spacer is thermally shrunk on the tie-bolt and/or on the inner separation pipe.

19. The gas turbine as claimed in claim 1, wherein the spacer is provided between tie-bolt and a rotor disk, the rotor disk carrying the plurality of rotor blades on the periphery.

* * * * *